United States Patent [19]

Pilatowicz

[11] 4,127,090

[45] Nov. 28, 1978

[54] CARBURETOR THROTTLE LOCK

[75] Inventor: Edward J. Pilatowicz, Los Angeles, Calif.

[73] Assignee: McCulloch Corporation, Los Angeles, Calif.

[21] Appl. No.: 798,859

[22] Filed: May 20, 1977

[51] Int. Cl.[2] ..... F02D 11/02

[52] U.S. Cl. ..... 123/98; 123/179 C; 261/65

[58] Field of Search ..... 123/179 C, 179 G, 98, 123/119 F, 198 DB; 74/513; 261/65

[56] References Cited

U.S. PATENT DOCUMENTS

| | | | |
|---|---|---|---|
| 1,838,289 | 12/1931 | Smith | 123/179 C |
| 2,071,695 | 2/1937 | Hyde | 74/513 |
| 2,072,285 | 3/1937 | Walher | 74/513 |
| 2,770,146 | 11/1956 | Winkler | 261/52 |
| 2,798,468 | 7/1975 | Heidner | 123/98 |
| 2,873,731 | 2/1959 | Richardson | 123/99 |
| 2,982,275 | 5/1961 | Donan et al. | 123/119 |
| 3,920,777 | 11/1975 | Harrison | 261/39 B |

*Primary Examiner*—Charles J. Myhre
*Assistant Examiner*—David D. Reynolds
*Attorney, Agent, or Firm*—Kenway & Jenney

[57] ABSTRACT

An idle speed control mounted on the body of a carburetor for controlling the idle speed of an internal combustion engine is disclosed. In a first condition, the throttle plate is maintained in a position to provide a "normal" idle speed and in a second condition a fixed engagement between the stop means and the throttle plate provides a fast "start-up" idle condition. In a preferred embodiment in the first condition, the throttle plate engages the stop means and the engagement is variably adjustable to vary the "normal" idle speed. The engagement of the throttle plate with stop means in the second condition is stable but may be released by movement of a throttle trigger.

9 Claims, 4 Drawing Figures

CARBURETOR THROTTLE LOCK

This invention relates to carburetors, and in particular, to an apparatus for locking a carburetor throttle plate in a partially open state corresponding to a fast idle condition.

BACKGROUND OF THE INVENTION

Many small internal combustion engines, for example those associated with outdoor power equipment such as, for example, a chain saw, are started by a rope pull starter. While the rope is being pulled, it is not uncommon for the user at the same time to maintain the throttle in a partially or completely open condition in order to aid engine start-up by providing the engine with an increased flow of an air/fuel mixture. Any engine driven equipment, however, is potentially dangerous if used negligently or carelessly, and therefore it is desirable that one hand be free to hold or stabilize the equipment during start-up.

In those kinds of equipment where one hand is needed to maintain the throttle in a partially open or fully open position, however, it is difficult, and in some kinds of equipment, impossible, to effectively hold the apparatus in a stable position during start-up. To relieve this problem, the throttle has been provided with a throttle lock on the handle of the apparatus to maintain the throttle plate in a desired starting position. These locks however require an adjustment device to allow for the buildup of tolerances from the throttle trigger through the wire linkage and the holes of the bellcrank in the carburetor. Thus, these devices are necessarily more expensive and sometimes less reliable than may otherwise be desired.

It is therefore an object of this invention to provide a carburetor throttle lock which is very reliable, low in cost, and which does not require continuous adjustment because of the buildup of tolerances in the lock to carburetor linkage. Other objects of the invention are to provide an apparatus which may be attached to the carburetor itself, which is automatically released when the throttle trigger is used and which does not require user adjustment.

A further object of the invention is to provide a throttle lock for an internal combustion engine operated apparatus which provides a user with a safe and stable engine start-up procedure.

It is another object of the invention to provide a throttle lock which cannot be accidentally engaged while operating the engine.

SUMMARY OF THE INVENTION

The invention features an idle speed control mounted on the body of a carburetor for controlling the idle speed of an internal combustion engine. The carburetor is typical of those having a throttle plate variably positionable from a first state in which an operatively associated throttle valve is in an open position to a second state wherein the throttle valve is in a closed position. The throttle plate thereby controls passage of an air/fuel mixture from the carburetor to the engine. The control includes an adjustable stop means operable to cooperate with the throttle plate to restrict movement of the plate towards the second state. A first resilient means is operable to urge the throttle plate toward the second state. The stop means is moveable from a first condition, in which the throttle plate is in a normal operating condition with the associated throttle plate in a substantially closed position, to a releasable second condition wherein the throttle plate abuts the stop means in a fixed, fast idle condition and in which the associated throttle valve is in a partially open position. A second resilient means is provided for urging the stop means from the second condition to the first condition when the stop means is in the second condition.

In a preferred embodiment of the invention, the carburetor control further features the adjustable stop means operatively positioned with respect to the throttle plate to restrict movement of the plate toward the second state. A resilient means to urge the throttle plate toward the second state and into an abutting engagement with the stop means is provided and the stop means is itself moveable from a first condition in which the abutting engagement of the stop means and the throttle plate is fixed.

In a particular embodiment of the invention, the throttle plate is operably positioned to engage and releasably hold the stop means in the second condition.

DESCRIPTION OF THE DRAWINGS

Other objects, features and advantages of the invention will appear from the following description of a preferred embodiment taken together with the drawings in which.

DESCRIPTION OF A PREFERRED EMBODIMENT

Figure 1:
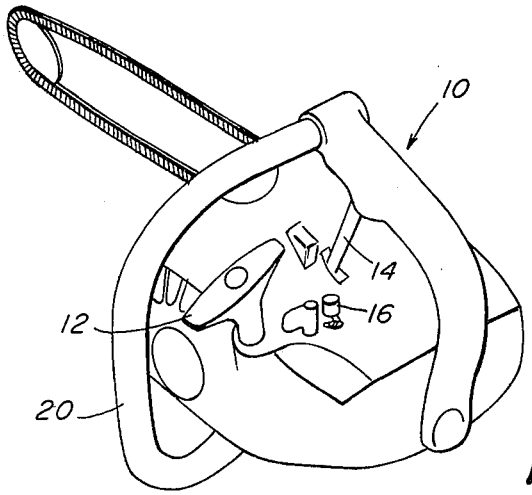
FIG. 1 is a perspective view of a chain saw incorporating the idle speed control according to the present invention.

Referring to FIG. 1, the throttle lock control of the present invention is most advantageously used in connection with outdoor internal combustion engine driven equipment, and in particular a chain saw 10. The chain saw is typically a hand held apparatus which is started by a rope pull device 12. During a typical prior art starting sequence, a throttle trigger (not shown) is moved to increase the amount of air/fuel mixture reaching the engine from the engine carburetor, thereby aiding engine startup, as rope pull device 12 is pulled to crank the engine. According to the present invention, an adjustable stop means 16 can be moved and releasably held in position by a resiliently biased throttle plate 18 to provide a fast idle condition whereby the user may hold the chain saw at a convenient location, for example handle 20, with one hand and crank the engine by pulling rope pull 12 with the other. This provides a potentially safer and more reliable starting procedure because the air/fuel mixture to the engine is controllably preset by the configuration and size of adjustable stop means 16 and a more controlled manner of holding the apparatus during start-up.

Figure 2:
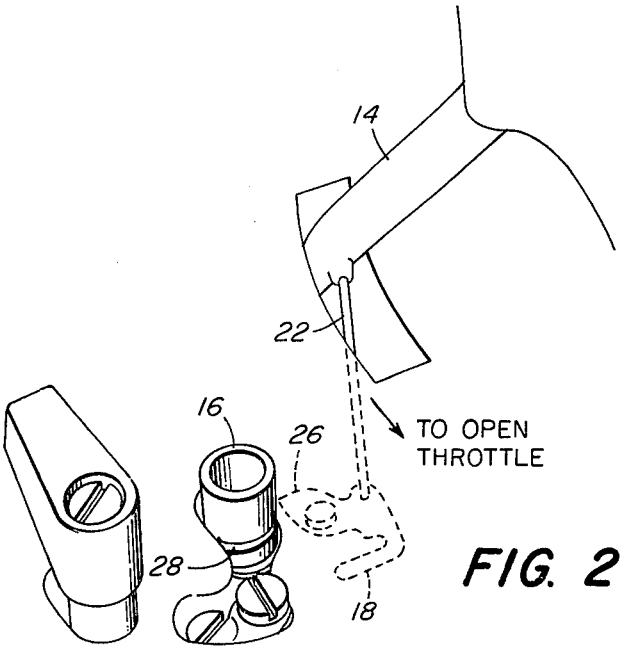
FIG. 2 is a perspective detail outlining that portion of the carburetor including the idle speed control according to the invention.

Referring to FIG. 2, throttle plate 18 is connected to and moves in response to the throttle trigger through a connecting member 21 and a throttle link 22. Throttle plate 18 is normally variably positioned from the first state in which an associated throttle valve (not shown)

is in an open position to a second state wherein the throttle valve is in a closed position. This corresponds to varying the rate of flow of an air/fuel mixture applied to the engine. Thus, prior to starting the engine, the throttle valve is set (as described below) at a somewhat open position thereby allowing a rate of flow of air/fuel mixture to reach the engine which provides for a fast engine idle. It is when the adjustable stop means 16 is releasably held in a position corresponding to a fast idle that the throttle plate 18 is positioned to hold the throttle valve in the "somewhat open position".

In this preferred embodiment, if no force is exerted to pull the throttle trigger rearward, throttle plate 18 is resiliently urged into an abutting engagement with adjustable stop means 16 at an end 26. When the throttle trigger is pulled rearward, plate 18 is moved into a position in which end 26 is spaced apart from the adjustment means. Adjustment means 16 may then be depressed to a condition wherein a groove 28 is placed in the plane of travel of throttle plate 18 and throttle plate 18 is then released and is resiliently urged against the adjustable means 16 at groove 28 whereby throttle plate end 26 rests in groove 28. This both prevents adjustable means 16 from being resiliently biased upward to its normal idle condition and provides the "fast idle" condition wherein the throttle valve is somewhat open.

Once the engine has been started, substantially any movement of the throttle trigger causes throttle plate end 26 to move away from adjustable stop means 16, and in particular away from groove 28, sufficiently to allow the adjustment means 16 to be resiliently biased upwards to its normal idle condition. In that condition, adjustment means 16 is variably adjustable by a screw adjustment to be described below whereby throttle plate end portion 26, when throttle trigger is released, rests upon a cone-shaped exterior surface portion 38 of adjustment means 16.

Figure 4:
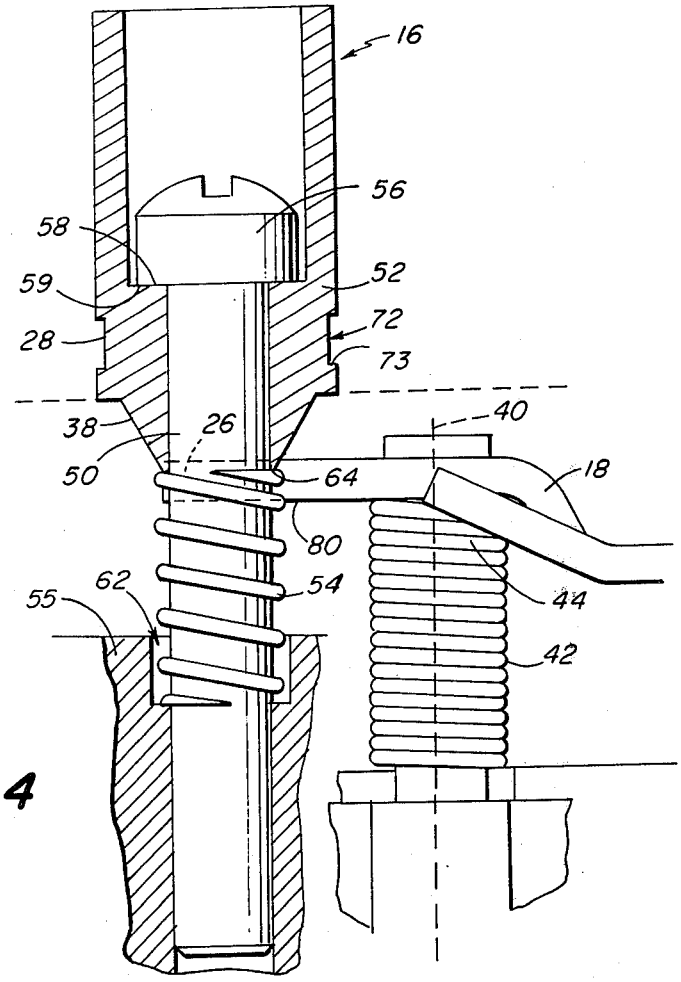
FIG. 4 is a cross-sectional view taken along lines 4—4 of FIG. 3.
Figure 3:
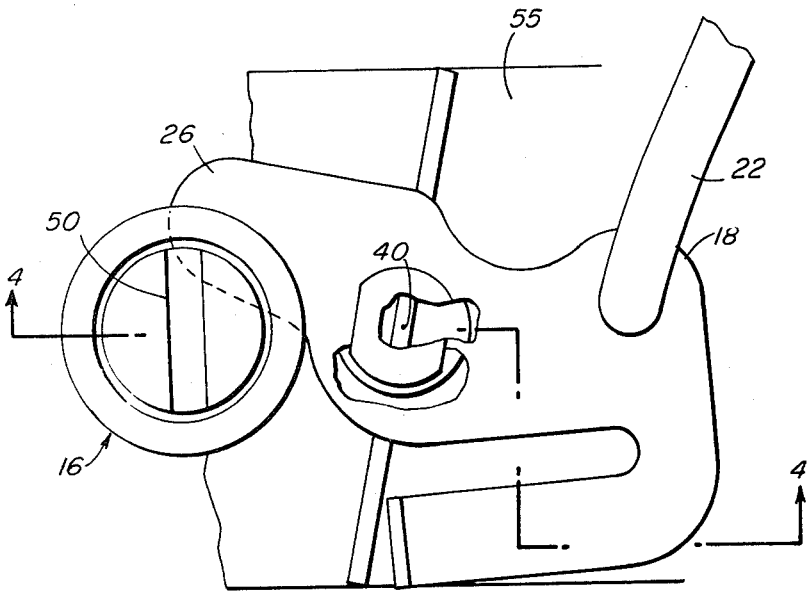
FIG. 3 is a top plan view showing the positional relationship of the idle speed control and the throttle plate.

Referring to FIGS. 3 and 4, throttle plate 18 is pivotably mounted for movement in a plane normal to a longitudinal axis at 40 and is resiliently urged towards adjustable means 16 by a coaxial spring 42 wound about a connecting shaft 44. As noted above, the throttle trigger, connected to throttle plate 18 by connecting member 21 and throttle link 22, urges throttle plate 18 away from adjustable means 16 to increase the rate of flow of the air/fuel mixture into the engine.

Adjustable means 16 comprises a securing device, an attachment screw 50, a hollow tubular member 52, and a resilient means, coaxial spring 54. Hollow member 52 is secured to a carburetor body 55 by screw 50. Screw 50 passes through the preferably circular interior cross section of tubular member 52. Attachment screw 50 has a head 56 which rests upon the interior shoulder surface 58 of hollow tubular member 52. Surface 58 of member 52 is resiliently urged against the lower surface of head 56 by spring 54 which is mounted coaxially with screw 50 and which seats in counterbored depression 62 in carburetor body 55. Spring 54 seats at its other end against a lower surface portion 64 of hollow member 52.

The exterior surface of hollow member 52 is configured to include the cone-shaped portion 38 and a grooved portion 72 having groove 28. As noted above, the end 26 of throttle plate 18 rests, during normal idle, against the outside surface of member 52 in an abutting engagement. Thus, by adjusting the depth of penetration of screw 50 into carburetor block 55, the relative position of hollow member 52 and in particular of cone-shaped portion 38 relative to the end 26 of throttle plate 18 mays be controllably changed thereby changing the angular position of throttle plate 18 and hence adjusting the normal idle speed of the engine.

As shown in FIG. 4, the diameter of groove 28 is preferably greater than the outside diameter of any portion of cone-shaped portion 38. Therefore the fast idle condition provides an engine idle speed greater than the maximum adjustable normal idle speed.

In operation, if the throttle plate is pivoted away from hollow member 52, member 52 may be depressed against the resilient spring pressure until groove 28 is aligned with the plane of movement of end 26. (Preferably this occurs when member 52 has been fully depressed.) End 26 is then allowed to return to an abutting engagement with the surface of groove 28 and thereafter hollow member 52 is released. However, the lower circumferential shoulder surface 78 of groove 28 then abuts the lower surface 80 of end portion 26 whereby the hollow member is releasably held in a depressed condition. In this condition, the throttle plate 18 is pivoted away somewhat from its closed position by a fixed predetermined amount and provides a controlled "fast idle" condition for starting the engine. When the throttle trigger and hence throttle plate 18 are moved, hollow member 52 returns to its normal idle condition as determined by the depth of penetration of screw 50 in carburetor body 55.

In other particular embodiments of the invention, the adjustable feature of the stop means may not be used and the throttle plate may not even engage the stop means during the "normal" idle condition. For example, the throttle plate may rest upon the shaft of screw 50 and the conical shaped portion 38 of hollow tubular member 52 may be absent.

Furthermore, the stop means may take many other forms than that shown and described in the preferred embodiment of this invention. For example, the adjustable stop means may be a depressible spring clip, designed to interfere with the normal idle position of the throttle plate during the fast idle condition and to automatically return to a non-engaging relationship with the throttle plate during the normal idle condition. Such other embodiments would, like the preferred embodiment of the invention, provide the stop means with a resilient member to urge it from the second condition in which it engages the throttle plate to the first condition upon actuation of the throttle trigger.

ADVANTAGES OF THE INVENTION AND UNOBVIOUSNESS

The invention provides an idle speed control which may be releasably held in a fast idle condition so that an outdoor apparatus may be more safely started.

The control advantageously is positioned on the carburetor body thereby eliminating various sources of error and the buildup of a plurality of tolerances.

The idle control further advantageously allows for safer start-up by freeing one hand to steady the internal combustion engine powered apparatus.

The control further advantageously allows the fast idle condition to be quickly released by movement of the throttle trigger.

The present invention is a significant, patentable, and unobvious improvement over other known structures for maintaining fast idle speeds as shown in and described by the prior art. In particular, a Walbro idle adjustment having a cone-shaped portion mounted on the carburetor body for adjustably controlling the "normal" idle speed of the carburetor by a screw positioning means, may, according to the prior art, include a fast idle condition lock which was mounted in or at the handle of the apparatus. Thus, in the described preferred embodiment of the invention, the cone-shaped member and its mounting are structurally changed to provide the fast idle adjustment having the advantages noted above. In particular, the claimed invention avoids the problems of mechanically changing linkages and misadjustments of the prior art and provides a patentable advance over that art.

Furthermore, of course, the present invention is not limited to the cone-shaped member and is directed broadly to the incorporation of a fast idle control which is mounted on the carburetor body as opposed and distinguished from the controls which are mounted not on the carburetor body, but at some distance from the body. It cannot be strongly enough urged and noted that this seemingly simple step of mounting the adjustment on the carburetor body provides a significantly more reliable and precise control over the speed during the fast idle condition.

Other embodiments of the invention, including different configuations of idle control devices such as different throttle plates and adjustable stop means, will be obvious to those skilled in the art and are within the scope of the following claims.

What is claimed is:

1. An idle speed control mounted on the body of a carburetor for controlling the idle speed of an internal combustion engine, the carburetor having a throttle plate variably positionable from a first state wherein an operatively associated throttle valve is in an open position to a second state wherein said throttle valve is in a closed position, said plate thereby controlling passage of an air/fuel mixture from the carburetor to said engine, the control including an adjustable stop means operable to cooperate with said throttle plate to restrict movement of said plate towards said second state, a first resilient means operable to urge said throttle plate towards said second state, said stop means being moveable from a first condition, wherein the throttle plate is in a normal operating condition with said associated throttle valve in a substantially closed position, to a releasable second condition wherein said throttle plate abuts the stop means in a fixed, fast idle condition wherein said associated throttle valve is in a partially open position, and second resilient means for urging said stop means from said second condition to said first condition when the stop means is in said second condition.

2. An idle speed control mounted on a carburetor for controlling the idle speed of an internal combustion engine, the carburetor having a throttle plate variably positionable from a first state wherein an operatively associated throttle valve is in an open position to a second state wherein said throttle valve is in a closed position, said plate thereby controlling passage of an air/fuel mixture from the carburetor to said engine, the control including an adjustable stop means operatively positioned with respect to said throttle plate to restrict movement of said plate towards said second state, a first resilient means to urge said throttle plate towards said second state and into an abutting engagement with said stop means, said stop means being moveable from a first condition, wherein the abutting engagement of said stop means and said throttle plate is adjustably variable to a releasable second condition wherein said abutting engagement of the stop means and the throttle plate is fixed, and second resilient means for urging said stop means from said second condition to said first condition when the stop means is in said second condition.

3. The idle speed control of claim 2 wherein said plate is operably positioned to engage and releasably hold said stop means in said second condition.

4. The control means of claim 3 wherein said stop means comprises a hollow tubular member, said member having a cone-shaped outside surface portion inwardly converging at one end of the member, and a circumferential groove adjacent said cone-shaped portion, and a securing device to secure the tubular member to the carburetor in said operational relation to the throttle plate.

5. The control means of claim 4 wherein said securing device is a screw, the body of said screw passing through the hollow interior of said tubular member and adjustably secured to the body of said carburetor, said second resilient means urges said tubular member away from said carburetor body, and said screw and tubular member are operatively adapted to vary the distance between said tubular member and said body.

6. The control means of claim 5 wherein said cone-shaped portion of said member is closest to said carburetor body.

7. The control means of claim 6 wherein said throttle plate normally engages said cone-shaped portion and said member can be urged, against said second resilient means to said second condition, whereby said throttle plate intersects and rests within said grooved portion.

8. The control means of claim 3 further including a throttle trigger and a throttle linkage connecting said throttle trigger to said throttle plate, whereby movement of said throttle trigger releases said stop means to enable to stop means to move from said second condition to said first condition.

9. An idle speed control mounted on the body of a carburetor for controlling the idle speed of an internal combustion engine for a chain saw, the carburetor having a throttle plate variably positionable from a first state wherein an operatively associated throttle valve is in an open position to a second state wherein the throttle valve is in a closed position, the plate thereby controlling passage of an air/fuel mixture from the carburetor to the engine, the control including an adjustable stop means operatively positioned with respect to the throttle plate to restrict movement of the plate toward the second state, the stop means including a hollow tubular member, said member having a cone-shaped outside surface portion inwardly converging at one end of the member, and a circumferential groove adjacent the cone-shaped portion, a securing device to secure the tubular member to the carburetor in an operational relation to the throttle plate, said securing device being a screw, the body of the screw passing through the hollow interior of said tubular member and adjustably secured to the body of the carburetor, and a coaxial spring secured about the screw between the hollow member and the carburetor body, to urge the tubular member away from the carburetor body, said screw and said tubular member operatively adapted to vary the distance of the tubular member from said body, and said cone-shaped portion being closer to said carburetor body than said groove, said stop means being moveable from a first condition wherein the abutting engagement of the stop means and the throttle plate is adjustably variable to a releasable second condition wherein the abutting engagement of the stop means and the throttle plate is fixed, and a resilient means to urge the throttle plate toward the second state and into said abutting engagement with the stop means.

* * * * *